US011674196B2

(12) United States Patent
Chung et al.

(10) Patent No.: US 11,674,196 B2
(45) Date of Patent: Jun. 13, 2023

(54) STEEL REINFORCING BAR AND PRODUCTION METHOD THEREFOR

(71) Applicant: Hyundai Steel Company, Incheon (KR)

(72) Inventors: Jun Ho Chung, Gyeonggi-do (KR); Tae Hyung Kim, Gyeonggi-do (KR); Ju Sang Lee, Gyeonggi-do (KR); Se Jin Kim, Seoul (KR); Kyoung Rok Lim, Seoul (KR)

(73) Assignee: Hyundai Steel Company, Incheon (KR)

( * ) Notice: Subject to any disclaimer, the term of this patent is extended or adjusted under 35 U.S.C. 154(b) by 138 days.

(21) Appl. No.: 16/957,406

(22) PCT Filed: Jan. 22, 2018

(86) PCT No.: PCT/KR2018/000953
§ 371 (c)(1),
(2) Date: Jun. 24, 2020

(87) PCT Pub. No.: WO2019/132098
PCT Pub. Date: Jul. 4, 2019

(65) Prior Publication Data

US 2020/0347480 A1 Nov. 5, 2020

(30) Foreign Application Priority Data

Dec. 29, 2017 (KR) ..... 10-2017-0184688

(51) Int. Cl.
*C21D 9/00* (2006.01)
*C21D 6/00* (2006.01)
(Continued)

(52) U.S. Cl.
CPC ..... *C21D 9/525* (2013.01); *C21D 6/004* (2013.01); *C21D 6/005* (2013.01); *C21D 6/008* (2013.01);
(Continued)

(58) Field of Classification Search
CPC ..... C21D 9/525; C21D 6/004; C21D 6/005; C21D 6/008; C21D 8/065; C21D 8/08;
(Continued)

(56) References Cited

U.S. PATENT DOCUMENTS 8,757,422 B2 6/2014 Nishizaki et al.
2016/0237515 A1* 8/2016 Kajihara ..... C22C 38/001

FOREIGN PATENT DOCUMENTS

CN 101001971 A 7/2007
CN 103422033 A 12/2013
(Continued)

*Primary Examiner* — Anthony M Liang
*Assistant Examiner* — Danny N Kang
(74) *Attorney, Agent, or Firm* — Fox Rothschild LLP

(57) ABSTRACT

A steel reinforcing bar contains 0.06 wt % to 0.11 wt % carbon, more than 0 and not more than 0.25 wt % silicon, 0.8 wt % or more and less than 2.0 wt % manganese, more than 0 and not more than 0.01 wt % phosphorus, more than 0 and not more than 0.01 wt % sulfur, 0.01 to 0.03 wt % aluminum, 0.50 to 1.00 wt % nickel, 0.027 to 0.125 wt % molybdenum, more than 0 and not more than 0.25 wt % chromium, more than 0 and not more than 0.28 wt % copper, more than 0 and not more than 0.01 wt % nitrogen, and the remainder being iron and unavoidable impurities. The reinforcing bar has a surface layer and a core. The surface layer has a hardened layer of tempered martensite, and the core has a mixed structure of bainite, ferrite and pearlite.

3 Claims, 2 Drawing Sheets

(51) Int. Cl.

| | |
|---|---|
| ***C22C 38/00*** | (2006.01) |
| ***C21D 9/52*** | (2006.01) |
| ***C21D 8/06*** | (2006.01) |
| ***C21D 8/08*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 8/065* (2013.01); *C21D 8/08* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/58* (2013.01); *C21D 2211/002* (2013.01); *C21D 2211/005* (2013.01); *C21D 2211/009* (2013.01)

(58) Field of Classification Search
CPC ..... C21D 2211/002; C21D 2211/005; C21D 2211/009; C21D 9/08; C21D 9/52; C22C 38/001; C22C 38/002; C22C 38/02; C22C 38/06; C22C 38/42; C22C 38/44; C22C 38/58
See application file for complete search history.

(56) References Cited

FOREIGN PATENT DOCUMENTS

| | | | | | |
|---|---|---|---|---|---|
| CN | 104350167 | A | * | 2/2015 | ..... C21D 8/06 |
| CN | 104350167 | A | | 2/2015 | |
| JP | 2000-129394 | A | | 5/2000 | |
| KR | 2009-0132796 | A | | 12/2009 | |
| KR | 2013-0002181 | A | | 1/2013 | |
| KR | 2015-0013246 | A | | 2/2015 | |
| KR | 2017-0075936 | A | | 7/2017 | |
| KR | 101757591 | B1 | | 7/2017 | |

* cited by examiner

STEEL REINFORCING BAR AND PRODUCTION METHOD THEREFOR

CROSS-REFERENCE TO RELATED APPLICATIONS

This application is a National Phase application filed under 35 USC 371 of PCT International Application No. PCT/KR2018/000953 with an International Filing Date of Jan. 22, 2018, which claims under 35 USC 119(a) the benefit of Korean Application No. 10-2017-0184688 filed on Dec. 29, 2017 in the Republic of Korea, the entire contents of which are incorporated herein.

BACKGROUND

(a) Technical Field

The present disclosure relates to a steel reinforcing bar and a production method therefor, more particularly, to a steel reinforcing bar which is applied to cryogenic environments and a production method therefor.

(b) Description of the Related Art

Carbon steel has been used in structures that provide spaces for human activities. For example, carbon steel is a structural steel, and has been widely applied to various fields, including skyscrapers, long-span bridges, large marine structures, underground structures, and storage tanks. As an example, in such applications, steel reinforcing bars have been utilized.

Meanwhile, in recent years, interest in natural gas as an energy source has increased with the development of mining technology. Mined natural gas can be liquefied at a temperature of −170° C. or lower and stored as liquefied natural gas (LNG) in storage tanks. As storage tanks for storing the liquefied natural gas, structures made of concrete reinforced with steel reinforcing bars have been commonly used. The structures are required to have cryogenic properties in order to prevent leakage of liquefied natural gas. An example of a cryogenic tank for storing liquefied natural gas is disclosed in U.S. Pat. No. 8,757,422.

SUMMARY

The present disclosure provides a steel reinforcing bar, which is capable of ensuring toughness and ductility in a cryogenic environment, and a production method therefor.

A steel reinforcing bar according to one aspect of the present disclosure contains 0.06 wt % to 0.11 wt % of carbon (C), more than 0 and not more than 0.25 wt % of silicon (Si), 0.8 wt % or more and less than 2.0 wt % of manganese (Mn), more than 0 and not more than 0.01 wt % of phosphorus (P), more than 0 and not more than 0.01 wt % of sulfur (S), 0.01 to 0.03 wt % of aluminum (Al), 0.50 to 1.00 wt % of nickel (Ni), 0.027 to 0.125 wt % of molybdenum (Mo), more than 0 and not more than 0.25 wt % of chromium (Cr), more than 0 and not more than 0.28 wt % of copper (Cu), more than 0 and not more than 0.01 wt % of nitrogen (N), and the remainder being iron (Fe) and unavoidable impurities. The steel reinforcing bar has a surface layer and a core excluding the surface layer. Here, the steel reinforcing bar has, in the surface layer, a hardened layer of tempered martensite, and has, in the core, a mixed structure of bainite, ferrite and pearlite.

In one embodiment, the core of the steel reinforcing bar may include, by area fraction, 35 to 45% of bainite, 45 to 55% of needle-like ferrite and 5 to 15% of pearlite.

In one embodiment, the steel reinforcing bar may satisfy a yield strength (YS) of 500 MPa or more, a tensile strength (TS)/yield strength (YS) ratio of 1.15 or more, and an elongation of 10% or more, at room temperature, and may have a uniform elongation of 3% or more as measured on an unnotched specimen at −170° C., and a notch sensitivity ratio of 1.0 or more at −170° C. Here, the notch sensitivity ratio may be the ratio of (tensile strength of notched specimen)/(yield strength of unnotched specimen).

In one embodiment, the hardened layer may have a depth corresponding to 0.31 to 0.55 times the radius of the steel reinforcing bar from the surface of the reinforcing steel bar.

In one embodiment, the ferrite in the core may have a grain size of 9 to 11 μm.

A method for producing a steel reinforcing bar according to another aspect of the present disclosure includes steps of: reheating a slab, containing 0.06 wt % to 0.11 wt % of carbon (C), more than 0 and not more than 0.25 wt % of silicon (Si), 0.8 wt % or more and less than 2.0 wt % of manganese (Mn), more than 0 and not more than 0.01 wt % of phosphorus (P), more than 0 and not more than 0.01 wt % of sulfur (S), 0.01 to 0.03 wt % of aluminum (Al), 0.50 to 1.00 wt % of nickel (Ni), 0.027 to 0.125 wt % of molybdenum (Mo), more than 0 and not more than 0.25 wt % of chromium (Cr), more than 0 and not more than 0.28 wt % of copper (Cu), more than 0 and not more than 0.01 wt % of nitrogen (N), and the remainder being iron (Fe) and unavoidable impurities, at a temperature of 1,030° C. to 1,250° C.; hot-rolling the reheated slab at a finishing delivery temperature of 920° C. to 1,030° C. to form a steel reinforcing bar; and cooling the surface of the hot-rolled steel reinforcing bar to a martensite transformation starting temperature (Ms temperature) or lower through a TEMPCORE process. The TEMPCORE process includes a step of subjecting the steel reinforcing bar to recuperation at 520° C. to 600° C.

In one embodiment, the finishing delivery temperature may satisfy the condition of the following equation.

$$\text{finishing delivery temperature (° C.)} < (850 + 0.80 * Ae1/12.0 * [C] + 5.8 * [Mn] + 35.0 * [Ni]) - Ae3 \quad \text{Equation}$$

wherein each of Ae1 and Ae3 is given in units of temperature (° C.), [C] is the content of carbon in the slab and is given in units of wt %, [Mn] is the content of manganese in the slab and is given in units of wt %, [Ni] is the content of nickel in the slab and is given in units of wt %, the coefficient 0.80 is given without units, the coefficients 12.0 and 5.8 are given in units of 1/wt %, and the constant 850 is given in units of temperature (° C.).

In one embodiment, the produced steel reinforcing bar may include tempered martensite in the surface layer thereof, and may have a mixed structure of bainite, ferrite and pearlite in the core thereof.

In one embodiment, the steel reinforcing bar has a surface layer and a core excluding the surface layer. The steel reinforcing bar may have, in the surface layer, a hardened layer consisting essentially of tempered martensite, and include, in the core, by area fraction, 35 to 45% of bainite, 45 to 55% of needle-like ferrite and 5 to 15% of pearlite.

In one embodiment, the produced steel reinforcing bar may satisfy a yield strength (YS) of 500 MPa or more, a tensile strength (TS)/yield strength (YS) ratio of 1.15 or more, and an elongation of 10% or more, at room temperature, and may have a uniform elongation of 3% or more as measured on an unnotched specimen at −170° C., and a notch sensitivity ratio of 1.0 or more at −170° C. Here, the notch sensitivity ratio may be the ratio of (tensile strength of notched specimen)/(yield strength of unnotched specimen).

According to the present disclosure, through optimized alloy components and process control, it is possible to provide a steel reinforcing bar, which is capable of ensuring toughness and ductility at cryogenic temperatures, and a production method therefor.

DETAILED DESCRIPTION

Figure 1:
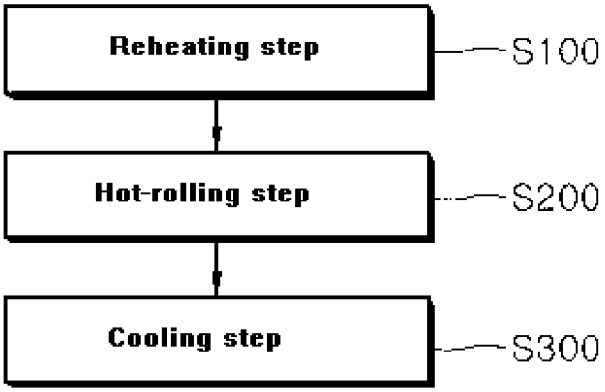
FIG. 1 is flow chart schematically showing a method for producing a steel reinforcing bar according to one embodiment of the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof. Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, the present disclosure will be described in detail with reference to the accompanying drawings so that it can be easily carried out by those skilled in the art to which the present disclosure pertains. The present disclosure may be embodied in various different forms and is not limited to the embodiments described in the present specification. Like reference numerals denote the same or similar components throughout the present specification. In addition, when publicly-known functions and constructions may unnecessarily obscure the subject matter of the present disclosure, the detailed description thereof will be omitted.

Embodiments of the present disclosure, which are described below, provides a steel reinforcing bar for cryogenic use, which ensures toughness and ductility at cryogenic temperatures, through proper component design and process control. In an embodiment of the present disclosure, the alloy composition (including carbon, nickel, and manganese, etc.) in the steel reinforcing bar may be controlled in order to improve cryogenic toughness and ductility. Such an alloy composition may be advantageous for obtaining a low-temperature phase such as bainite. In addition, in an embodiment of the present disclosure, components and processes may be controlled so that the steel reinforcing bar may have a microstructure capable of preventing crack propagation.

Steel Reinforcing Bar

One embodiment of the present disclosure provides a steel reinforcing bar containing 0.06 wt % to 0.11 wt % of carbon (C), more than 0 and not more than 0.25 wt % of silicon (Si), 0.8 wt % or more and less than 2.0 wt % of manganese (Mn), more than 0 and not more than 0.01 wt % of phosphorus (P), more than 0 and not more than 0.01 wt % of sulfur (S), 0.01 to 0.03 wt % of aluminum (Al), 0.50 to 1.00 wt % of nickel (Ni), 0.027 to 0.125 wt % of molybdenum (Mo), more than 0 and not more than 0.25 wt % of chromium (Cr), more than 0 and not more than 0.28 wt % of copper (Cu), more than 0 and not more than 0.01 wt % of nitrogen (N), and the remainder being iron (Fe) and unavoidable impurities.

The steel reinforcing bar may have a surface layer and a core excluding the surface layer. The steel reinforcing bar may have, in the surface layer, a hardened layer consisting essentially of tempered martensite. As an example, the surface layer may consist of the hardened layer. The steel reinforcing bar may have, in the core, a mixed structure of bainite, ferrite and pearlite.

The hardened layer may have a depth corresponding to 0.31 to 0.55 times the radius of the steel reinforcing bar from the surface of the reinforcing steel bar. In one embodiment, when the steel reinforcing bar is sectioned in a direction perpendicular to the longitudinal direction of the steel reinforcing bar, the section may consist of the surface layer and the core. The surface layer may have an area fraction of 35 to 50% relative to the total area of the section. The surface layer may consist essentially of tempered martensite. Alternatively, the surface layer may include bainite present in an area fraction of less than about 10% based on the area fraction of the surface layer.

As described above, the remaining area except for the surface layer in the section of the steel reinforcing bar may be the core. For example, when the steel reinforcing bar is sectioned in a direction perpendicular to the longitudinal direction of the steel reinforcing bar, the core may have an area fraction of 50 to 65% relative to the total area of the section. In addition, the steel reinforcing bar may have, in the core, a mixed structure of bainite, ferrite and pearlite. The ferrite in the core may be needle-like ferrite. In one embodiment, the steel reinforcing bar may include bainite having an area fraction of 35 to 45%, needle-like ferrite having an area fraction of 45 to 55%, and pearlite having an area fraction of 5 to 15%, based on the total area of the core. At this time, the needle-like ferrite may have a grain size of 9 to 11 μm.

The steel reinforcing bar may satisfy a yield strength (YS) of 500 MPa or more, a tensile strength (TS)/yield strength (YS) ratio of 1.15 or more, and an elongation of 10% or more, at room temperature. In addition, the steel reinforcing bar may have a uniform elongation of 3% or more as measured on an unnotched specimen at −170° C., and a notch sensitivity ratio of 1.0 or more at −170° C. Here, the notch sensitivity ratio may be the ratio of (tensile strength of notched specimen)/(yield strength of unnotched specimen).

The uniform elongation at −170° C. and the notch sensitivity ratio at −170° C. are the results obtained by preparing specimens according to the European Standard EN 14620-3 and performing tensile testing on the specimens. As the specimens for tensile testing, an unnotched specimen and a notched specimen are prepared. The notched specimen according to the European Standard EN 14620-3 may have a V-notch having an internal angle of 45°, and the V-notch may have a radius of 0.25 mm at the base. The V-notch may be formed at a position corresponding to ½ of the length of the specimen between the grips of a tensile tester.

The uniform elongation may refer to elongation until necking occurs in the unnotched specimen when tensile testing is performed using the unnotched specimen. Accordingly, in this embodiment, the uniform elongation at −170° C. may be measured. In addition, after tensile testing is performed on each of the notched specimen and the unnotched specimen at −170° C., the notch sensitivity ratio may be calculated from the ratio of the tensile strength of the notched specimen to the yield strength of the unnotched specimen.

Hereinafter, the function and content of each component contained in the steel reinforcing bar according to the present disclosure will be described.

Carbon (C)

In the present disclosure, carbon (C) is added to secure the strength and hardness of the steel. Generally, carbon (C) is dissolved in austenite and forms a martensite structure upon quenching. In addition, generally, as the content of carbon increases, the quenching hardness increases, but deformation due to rapid cooling may occur or the elongation and low-temperature toughness of the steel may be deteriorated.

Carbon (C) is added in an amount of 0.06 wt % to 0.11 wt % based on the total weight of the steel reinforcing bar. If the content of carbon is less than 0.06 wt %, it may be difficult to ensure sufficient strength. On the other hand, if the content of carbon (C) is more than 0.11 wt %, the strength of the steel increases, but it may be difficult to secure sufficient elongation and low-temperature toughness.

Silicon (Si)

In the present disclosure, silicon (Si) is added as a deoxidizer for removing oxygen from the steel in a steelmaking process. In addition, silicon (Si) is a ferrite-stabilizing element having a solid solution strengthening effect, and is effective in improving the toughness and ductility of the steel by inducing ferrite formation.

Silicon (Si) is added in an amount of more than 0 and not more than 0.25 wt % based on the total weight of the steel reinforcing bar. Meanwhile, if the content of silicon (Si) is more than 0.25 wt %, a problem may arise in that oxides are formed on the steel surface, thus reducing the ductility of the steel.

Manganese (Mn)

Manganese (Mn) is an element that increases the strength and toughness of steel and also increases the hardenability of the steel. Manganese is added in an amount of 0.8 wt % or more and less than 2.0 wt % based on the total weight of the steel reinforcing bar. If the content of manganese is less than 0.8 wt %, it may be difficult to secure strength. On the other hand, if the content of manganese is 2.0 wt % or more, the strength of the steel increases, but defects such as cracking may occur during welding due to an increase in the amount of MnS-based non-metallic inclusions. In addition, manganese is an austenite-stabilizing element, and when it is added in an amount of 0.8 wt % or more and less than 2.0 wt %, it may be advantageous for formation of needle-like ferrite and bainite. Accordingly, a microstructure favorable to cryogenic toughness according to an embodiment of the present disclosure may be formed.

Phosphorus (P)

Phosphorus (P) is an element that partially contributes to strength enhancement, but when it is excessively contained, it degrades the ductility of the steel and causes variations in the properties of the final steel due to billet center segregation. P causes no special problem if it is uniformly distributed in the steel, but usually forms a harmful compound of $Fe_3P$. This $Fe_3P$ is extremely brittle and is segregated, and hence it is not homogenized even after annealing treatment, and elongates during processing such as forging or rolling.

The content of phosphorus (P) is limited to more than 0 and not more than 0.01 wt % based on the total weight of the steel reinforcing bar. If the content of phosphorus (P) is more than 0.01 wt %, it may form central segregation and microsegregation, which adversely affects the properties of the steel, and it may also degrade ductility and formability.

Sulfur (S)

Sulfur (S) is an element that partially contributes to the enhancement of processability, but when it is excessively contained, it impairs the toughness and ductility of the steel, and bonds with manganese to form a MnS non-metallic inclusion which causes cracks during processing of the steel. Sulfur can form FeS by bonding with iron if the amount of manganese in the steel is insufficient. Since the FeS is very brittle and has a low melting point, it can cause cracks during hot-rolling and cold-rolling processes.

The content of sulfur (S) is limited to more than 0 and not more than 0.01 wt % based on the total weight of the steel reinforcing bar. If the content of sulfur (S) is more than 0.01 wt %, a problem may arise in that sulfur significantly impairs ductility and causes excessive MnS non-metallic inclusions.

Aluminum (Al)

Aluminum (Al) can function as a deoxidizer. Aluminum (Al) may be added in an amount of 0.01 to 0.03 wt % based on the total weight of the steel reinforcing bar. If aluminum is added in an amount of less than 0.01 wt %, it may be difficult for aluminum to sufficiently exhibit the above effect. On the other hand, if aluminum is added in an amount of more than 0.03 wt %, it can increase the amount of non-metallic inclusions such as aluminum oxide ($Al_2O_3$).

Nickel (Ni)

Nickel (Ni) functions to increase the strength of the steel and allows a low-temperature impact value to be secured. Nickel is added in an amount of 0.50 to 1.00 wt % based on the total weight of the steel reinforcing bar. However, if the content of nickel is less than 0.50 wt %, it may be difficult to achieve the above object. On the other hand, when the content of nickel is more than 1.00 wt %, the strength of the steel at room temperature may excessively increase, so that the weldability and toughness of the steel may deteriorate.

Molybdenum (Mo)

Molybdenum (Mo) enhances the strength, toughness and hardenability of the steel. Molybdenum is added in an amount of 0.027 to 0.125 wt % based on the total weight of the steel reinforcing bar. If the content of molybdenum is less than 0.027 wt %, it may be difficult for molybdenum to exhibit the above effect. On the other hand, if the content of molybdenum is more than 0.125 wt %, there is a disadvantage in that the weldability of the steel deteriorates.

Chromium (Cr)

Chromium (Cr) can improve the hardenability of the steel, thus improving hardening penetration. In addition, chromium can achieve grain refinement by delaying the diffusion of carbon.

Chromium is added in amount of more than 0 and not more than 0.25 wt % based on total weight of the steel reinforcing bar. If chromium is added in an amount of more than 0.25 wt %, there is a disadvantage in that the weldability of the steel or the toughness of a heat-affected zone may deteriorate.

Copper (Cu)

Copper (Cu) may function to increase the hardenability and low-temperature impact toughness of the steel. In addition, copper can increase the corrosion resistance of the steel in the atmosphere or seawater. The content of copper (Cu) is limited to more than 0 and not more than 0.28 wt % based on the total weight of the steel reinforcing bar. If the content of copper is more than 0.28 wt %, it can reduce the hot workability of the steel and cause red shortness.

Nitrogen (N)

Nitrogen (N) may increase yield strength and tensile strength. Nitrogen refines austenite grains so that steel having fine grains may be produced. However, if nitrogen is added in a large amount of more than 0.01%, a problem may arise in that the elongation and formability of the steel are reduced due to an increased amount of nitrogen. Therefore, it is preferable to add nitrogen in an amount of more than 0 and not more than 0.01 wt % based on the total weight of the steel reinforcing bar.

In addition to the above-described components of the alloy composition, the remainder consists of iron (Fe) and impurities which are unavoidably contained during a steelmaking process and the like.

Method for Producing Steel Reinforcing Bar

Hereinafter, a method for producing a steel reinforcing bar according to one embodiment of the present disclosure will be described.

FIG. 1 is a flow chart schematically showing a method for producing a steel reinforcing bar according to one embodiment of the present disclosure. Referring to FIG. 1, the method for producing a steel reinforcing bar includes a slab reheating step (S100), a hot-rolling step (S200), and a cooling step (S300). Here, the reheating step (S100) may be performed to achieve effects such as re-dissolution of precipitates. Here, the slab may be obtained by obtaining molten steel having a predetermined composition through a steelmaking process, and then subjecting the molten steel to a continuous casting process. The slab may be in the form of, for example, a bloom or billet. The slab may contain 0.06 wt % to 0.11 wt % of carbon (C), more than 0 and not more than 0.25 wt % of silicon (Si), 0.8 wt % or more and less than 2.0 wt % of manganese (Mn), more than 0 and not more than 0.01 wt % of phosphorus (P), more than 0 and not more than 0.01 wt % of sulfur (S), 0.01 to 0.03 wt % of aluminum (Al), 0.50 to 1.00 wt % of nickel (Ni), 0.027 to 0.125 wt % of molybdenum (Mo), more than 0 and not more than 0.25 wt % of chromium (Cr), more than 0 and not more than 0.28 wt % of copper (Cu), more than 0 and not more than 0.01 wt % of nitrogen (N), and the remainder being iron (Fe) and unavoidable impurities.

Reheating Step

In the slab reheating step, the slab having the above-described composition is reheated in a temperature range of 1,030° C. to 1,250° C. Through such reheating, re-dissolution of components segregated during casting and re-dissolution of precipitation may occur. The slab may be a bloom or billet produced by a continuous casting process performed before the reheating step (S100).

If the reheating temperature of the slab is lower than 1030° C., the heating temperature may be insufficient, and hence re-dissolution of the segregated components and precipitates may not occur sufficiently. In addition, a problem may arise in that the rolling load increases. On the other hand, if the reheating temperature is higher than 1,250° C., austenite grains may be coarsened or decarburization may occur, resulting in a decrease in strength.

Hot Rolling

In the hot-rolling step (S200), the reheated slab is hot-rolled at a finishing delivery temperature of 920° C. to 1,030° C. to produce a steel reinforcing bar. The finishing delivery temperature may be a temperature equal to or higher than the non-crystallization temperature of austenite (Ar3) and the Ac3 transformation point.

If the finishing delivery temperature is higher than 1,030° C., coarse pearlite may be formed, thus making it difficult to ensure strength. On the other hand, if the finishing delivery temperature is lower than 920° C., a rolling load may occur, thus reducing productivity and the heat treatment effect.

In one embodiment, the finishing delivery temperature may satisfy the following Equation 1.

$$\text{finishing delivery temperature (° C.)} < (850 + 0.80 * Ae1/12.0 * [C] + 5.8 * [Mn] + 35.0 * [Ni]) - Ae3 \qquad \text{Equation 1}$$

wherein each of Ae1 and Ae3 is given in units of temperature (° C.), [C] is the content of carbon in the slab and is given in units of wt %, [Mn] is the content of manganese in the slab and is given in units of wt %, [Ni] is the content of nickel in the slab and is given in units of wt %, the coefficient 0.80 is given without units, the coefficients 12.0 and 5.8 are given in units of 1/wt %, and the constant 850 is given in units of temperature (° C.).

In Equation 1, Ae1 signifies the known critical temperature A1 related to the phase transformation in steel in an equilibrium state, and Ae3 signifies the known critical temperature A3 related to the phase change in steel in an equilibrium state.

Cooling

In the cooling step (S300), in order to secure sufficient strength, the surface of the hot-rolled steel reinforcing bar is cooled to a temperature equal to or lower than the martensitic transformation starting temperature (Ms) through a TEMPCORE process. During the TEMPCORE process, the cooled steel may be subjected to a recuperation process at a temperature of 520° C. to 600° C. After recuperation of the steel reinforcing bar, the steel reinforcing bar may be air-cooled.

The recuperation temperature may correspond to the speed at which the hot-rolled steel reinforcing bar passes through a water bath containing cooling water during the TEMPCORE process. According to one embodiment, the line speed of the steel reinforcing bar may be in a range of 7 to 11 meters/sec. If the line speed is lower than 7 meters/sec, excessive cooling may occur, and thus the recuperation temperature may become lower than 520° C. If the line speed is higher than 11 meters/sec, cooling may be insufficiently achieved, and thus the recuperation temperature may become higher than 600° C. That is, if the recuperation temperature according to the embodiment of the present disclosure is not ensured, the depth range of the hardened layer according to the embodiment of the present disclosure cannot be secured.

The steel reinforcing bar produced through the above-described process may have a surface layer and a core excluding the surface layer. The steel reinforcing bar may have, in the surface layer, a hardened layer consisting essentially of tempered martensite. As an example, the surface layer may consist of the hardened layer. The steel reinforcing bar may have, in the core, a mixed structure of bainite, ferrite and pearlite.

The hardened layer may have a depth corresponding to 0.31 to 0.55 times the radius of the steel reinforcing bar from the surface of the reinforcing steel bar. In one embodiment, when the steel reinforcing bar is sectioned in a direction perpendicular to the longitudinal direction of the steel reinforcing bar, the surface layer may have an area fraction of 35 to 50% relative to the total area of the section. The surface layer may consist essentially of tempered martensite. Alternatively, the surface layer may include bainite in an area fraction of less than about 10% based on the area fraction of the surface layer.

As described above, the remaining area except for the surface layer in the section of the steel reinforcing bar may be the core. For example, when the steel reinforcing bar is sectioned in a direction perpendicular to the longitudinal direction of the steel reinforcing bar, the core may have an area fraction of 50 to 65% relative to the total area of the section. In addition, the steel reinforcing bar may have, in the core, a mixed structure of bainite, ferrite and pearlite. The ferrite in the core may be needle-like ferrite. In one embodiment, the steel reinforcing bar may include bainite having an area fraction of 35 to 45%, needle-like ferrite having an area fraction of 45 to 55%, and pearlite having an area fraction of 5 to 15%, based on the total area of the core. At this time, the needle-like ferrite may have a grain size of 9 to 11 μm.

The produced steel reinforcing bar may satisfy a yield strength (YS) of 500 MPa or more, a tensile strength (TS)/yield strength (YS) ratio of 1.15 or more, and an elongation of 10% or more, at room temperature. In addition, the steel reinforcing bar may have a uniform elongation of 3% or more as measured on an unnotched specimen at −170° C., and a notch sensitivity ratio of 1.0 or more at −170° C. Here, the notch sensitivity ratio may be the ratio of (tensile strength of notched specimen)/(yield strength of unnotched specimen).

The uniform elongation at −170° C. and the notch sensitivity ratio at −170° C. are the results obtained by preparing specimens according to the European Standard EN 14620-3 and performing tensile testing on the specimens. As the specimens for tensile testing, an unnotched specimen and a notched specimen are prepared. The notched specimen according to the European Standard EN 14620-3 may have a V-notch having an internal angle of 45°, and the V-notch may have a radius of 0.25 mm at the base. The V-notch may be formed at a position corresponding to ½ of the length of the specimen between the grips of a tensile tester.

The uniform elongation may refer to elongation until necking occurs in the unnotched specimen when tensile testing is performed using the unnotched specimen. Accordingly, in this embodiment, the uniform elongation at −170° C. may be measured. In addition, after tensile testing is performed on each of the notched specimen and the unnotched specimen at −170° C., the notch sensitivity ratio may be calculated from the ratio of the tensile strength of the notched specimen to the yield strength of the unnotched specimen.

Meanwhile, the yield strength at room temperature may be designed to have the parameters as shown in Equation 2 below.

$$\text{Yield strength (MPa)}=(78*[HLVF]+1000/[FGD]+25.3*[\text{Mn}]+32.9*[\text{Ni}])/(0.0309*[FDT]+1.2*[MV]) \quad \text{Equation 2}$$

wherein [Mn] is the content of manganese in the slab and is given in units of wt %, [Ni] is the content of nickel in the slab and is given in units of wt %, [HLVF] is the area fraction of a hardened layer relative to the total area of the section in a direction perpendicular to the longitudinal direction of the steel reinforcing bar, [FGD] signifies the grain size of ferrite in the core of the steel reinforcing bar and is given in units of μm, [FDT] is the finishing delivery temperature during hot rolling and is given in units of ° C., [MV] is a line speed at which the hot-rolled steel reinforcing bar passes through a cooling water bath during the TEMPCORE process and is given in units of meters/sec, the coefficient 78 is given in units of MPa/%, the coefficient 1000 is given in units of MPa/μm, the coefficients 25.3 and 32.9 are given in units of MPa/wt %, the coefficient 0.0309 is given in units of 1/° C., and the coefficient 1.2 is given in units of sec/meter.

In Equation 2 above, the area fraction of the hardened layer of the steel reinforcing bar may be in a range of 35 to 50% relative to the total area of the section.

In addition, in Equation 2 above, the line speed may be in a range of 7 to 11 meters/sec.

As described above, through the reheating, hot rolling and cooling processes according to an embodiment of the present disclosure, it is possible to provide a steel reinforcing bar for cryogenic use that ensures toughness and ductility at cryogenic temperatures.

Hereinafter, the configuration and effects of the present disclosure will be described in more detail with reference to preferred examples. However, these examples are presented as preferred examples of the present disclosure and may not be construed as limiting the scope of the present disclosure in any way.

The contents that are not described herein can be sufficiently and technically envisioned by those skilled in the art, and thus the description thereof will be omitted herein.

Experiment 1

1. Preparation of Specimens

Billets were prepared, each consisting of the alloy composition shown in Table 1 below and the remainder being iron (Fe) and unavoidable impurities. The billets were subjected to reheating, hot-rolling and recuperation under the conditions shown in Table 2 below, thereby preparing specimens of Comparative Examples 1 to 6 and Examples 1 to 3.

TABLE 1

| | Chemical components (wt %) | | | | | | | | | | |
|---|---|---|---|---|---|---|---|---|---|---|---|
| | C | Si | Mn | P | S | Al | Cu | Cr | Ni | Mo | N |
| Comparative Example 1 | 0.27 | 0.12 | 1.00 | 0.026 | 0.024 | 0.015 | 0.23 | 0.11 | 0.02 | 0.02 | 0.01 |
| Comparative Example 2 | 0.13 | 0.12 | 1.55 | 0.01 | 0.01 | 0.015 | 0.24 | 0.12 | 0.60 | 0.04 | 0.01 |

TABLE 1-continued

| | Chemical components (wt %) | | | | | | | | | | |
|---|---|---|---|---|---|---|---|---|---|---|---|
| | C | Si | Mn | P | S | Al | Cu | Cr | Ni | Mo | N |
| Comparative Example 3 | 0.035 | 0.12 | 1.58 | 0.01 | 0.01 | 0.015 | 0.24 | 0.11 | 0.63 | 0.06 | 0.01 |
| Comparative Example 4 | 0.07 | 0.12 | 1.55 | 0.01 | 0.01 | 0.015 | 0.23 | 0.11 | 0.3 | 0.05 | 0.01 |
| Comparative Example 5 | 0.07 | 0.12 | 0.75 | 0.01 | 0.01 | 0.015 | 0.23 | 0.10 | 0.60 | 0.05 | 0.01 |
| Example 1 | 0.07 | 0.06 | 1.83 | 0.01 | 0.01 | 0.015 | 0.24 | 0.08 | 0.59 | 0.12 | 0.01 |
| Example 2 | 0.07 | 0.06 | 1.55 | 0.01 | 0.01 | 0.015 | 0.24 | 0.08 | 0.60 | 0.04 | 0.01 |
| Example 3 | 0.08 | 0.06 | 1.58 | 0.01 | 0.01 | 0.015 | 0.24 | 0.08 | 0.62 | 0.03 | 0.01 |

TABLE 2

| | Reheating temperature (° C.) | Finishing delivery temperature (° C.) | Recuperation temperature (° C.) |
|---|---|---|---|
| Comparative Example 1 | 1100 | 1020 | 585 |
| Comparative Example 2 | | | |
| Comparative Example 3 | | | |
| Comparative Example 4 | | | |
| Comparative Example 5 | | | |
| Example 1 | | | |
| Example 2 | | | |
| Example 3 | | | |

The content of carbon in Comparative Examples 1 and 2 is higher than the upper limit of the content range of carbon in the steel reinforcing bar of the present disclosure. The content of carbon in Comparative Example 3 is lower than the lower limit of the content range of carbon in the steel reinforcing bar of the present disclosure. The content of nickel in Comparative Example 4 is lower than the lower limit of the content range of nickel in the steel reinforcing bar of the present disclosure. The content of manganese in Comparative Example 5 is lower than the lower limit of the content range of manganese in the steel reinforcing bar of the present disclosure.

2. Evaluation of Physical Properties

Table 3 below shows the results of evaluating the mechanical properties of the specimens of Comparative Examples 1 to 5 and Examples 1 to 3, prepared according to the conditions shown in Tables 1 and 2 above. The properties to be evaluated were divided into room temperature properties and cryogenic properties at −170° C. The cryogenic properties are the results obtained by separately preparing specimens according to the European Standard EN 14620-3 and performing tensile testing on the specimens. As tensile specimens for evaluation of the cryogenic properties, unnotched specimens and notched specimen are prepared. The notched specimen according to the European Standard EN 14620-3 may have a V-notch having an internal angle of 45°, and the V-notch may have a radius of 0.25 mm at the base. The V-notch may be formed at a position corresponding to ½ of the length of the specimen between the grips of a tensile tester.

In addition, Table 3 also shows the results of observing the microstructures of the cores of the produced steel reinforcing bars.

TABLE 3

| | Room temperature properties | | | | Cryogenic properties (−170° C.) | | | | |
|---|---|---|---|---|---|---|---|---|---|
| | YS (MPa) | TS (MPa) | TS/YS | EL (%) | YS_un (MPa) | UE_un (%) | TS_n (MPa) | NSR | Microstructures of cores |
| Comparative Example 1 | 575 | 690 | 1.20 | 12.5 | 822 | 4.1 | 756 | 0.92 | P + F |
| Comparative Example 2 | 542 | 623 | 1.15 | 13.6 | 813 | 6.2 | 846 | 0.96 | F + B + P |
| Comparative Example 3 | 466 | 513 | 1.10 | 15.3 | 717 | 10.1 | 739 | 1.03 | F + P |
| Comparative Example 4 | 481 | 504 | 1.05 | 12.5 | 739 | 8.5 | 717 | 0.97 | F + B + P |
| Comparative Example 5 | 457 | 512 | 1.12 | 13.6 | 742 | 9.3 | 705 | 0.95 | F + P |
| Example 1 | 553 | 674 | 1.22 | 13.4 | 810 | 9.0 | 911 | 1.12 | F + B + P |
| Example 2 | 561 | 671 | 1.20 | 15.9 | 815 | 9.0 | 902 | 1.11 | F + P + P |
| Example 3 | 570 | 676 | 1.19 | 16.9 | 836 | 10.2 | 920 | 1.10 | F + B + P |

*In Table 3, P denotes pearlite, F denotes ferrite, and B denotes bainite.

The target values of room temperature properties of the steel reinforcing bar disclosed in the present application are a yield strength (YS) of 500 MPa or more, a tensile strength (TS)/yield strength (YS) ratio of 1.15 or more, and an elongation (EL) of 10% or more. In addition, the target values of the cryogenic properties are a uniform elongation (UE_un) of 3% or more as measured on the unnotched specimen at −170° C., and a notch sensitivity ratio (NSR) of 1.0 or more at −170° C. Here, the notch sensitivity ratio (NSR) may be the ratio of (tensile strength of notched specimen (TS_n))/(yield strength of unnotched specimen (YS_un)).

With regard to the evaluation of the cryogenic properties, the yield strength of the unnotched specimen (YS_un) may refer to the yield strength of tensile testing performed on the unnotched specimen at −170° C., and the tensile strength of the notched specimen (TS_n) may refer to the tensile strength of tensile testing performed on the notched specimen at −170° C. The uniform elongation (UE_un) may refer to elongation until necking occurs in the unnotched specimen when tensile testing is performed on the unnotched specimen at −170° C.

Referring to Table 3, the specimens of Examples 1 to 3 could satisfy the following target values at room temperature: a yield strength (YS) of 500 MPa or more, a tensile strength (TS)/yield strength ratio (YS) of 1.15 or more, and an elongation of 10% or more. In addition, the specimens of Examples 1 to 3 may have a uniform elongation of 3% or more as measured on the unnotched specimen at −170° C., and a notch sensitivity ratio of 1.0 or more at −170° C. Here, the notch sensitivity ratio may be the ratio of (tensile strength of notched specimen)/(yield strength of unnotched specimen).

Meanwhile, Comparative Examples 1 and 2 did not achieve a target value of notch sensitivity ratio of 1.0 or more at −170° C. That is, it is considered that Comparative Examples 1 and 2, in which the content of carbon is higher than that in the Examples, could not satisfy the cryogenic properties due to the increased fraction of pearlite.

Comparative Example 3 did not achieve a target value of yield strength of 500 MPa or more and a target value of tensile strength (TS)/yield strength (YS) ratio of 1.15 or more, at room temperature. That is, it is considered that Comparative Example 3, in which the content of carbon is lower than that in the Examples, could satisfy the cryogenic properties, but did not achieve the target values of strengths at room temperature, because the solid solution strengthening effect of carbon was insufficient and the formation of needle-like ferrite and bainite was insufficient.

Comparative Examples 4 and 5, in which the contents of nickel and manganese are lower than those in the Examples, did not achieve a target value of yield strength of 500 MPa or more and a target value of tensile strength (TS)/yield strength (YS) ratio of 1.15 or more, at room temperature, and a target value of notch sensitivity ratio of 1.0 or more at −170° C. That is, these Examples satisfied neither of the room temperature properties and the cryogenic properties.

3. Observation of Microstructures

Figure 2:
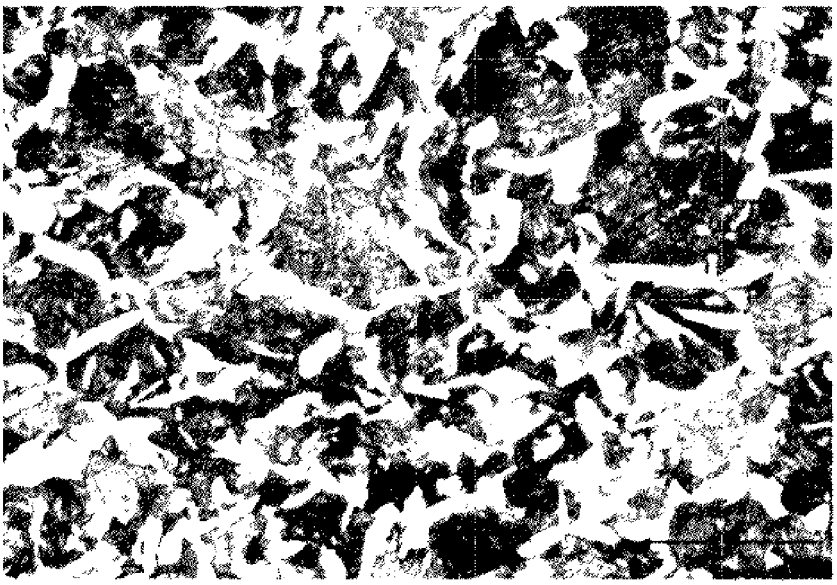
FIG. 2 is a photograph showing the microstructure of a steel reinforcing bar according to one embodiment of the present disclosure.
Figure 3:
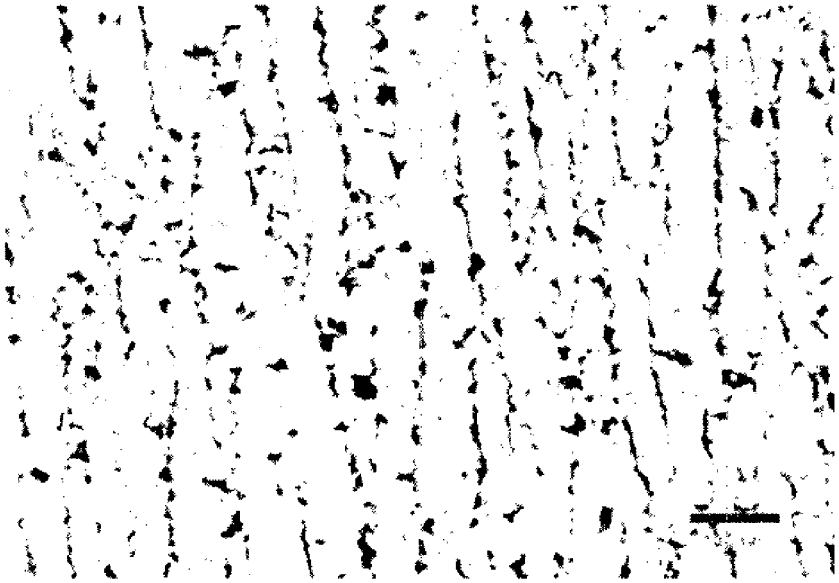
FIG. 3 is a photograph showing the microstructure of a steel reinforcing bar according to one embodiment of the present disclosure.

FIG. 2 is a photograph showing the structure of the core of the steel reinforcing bar according to one comparative embodiment of the present disclosure. FIG. 3 is a photograph showing the structure of the core of the steel reinforcing bar according to one embodiment of the present disclosure. Specifically, FIG. 2 is a photograph showing the structure of the specimen of Comparative Example 1, and FIG. 3 is a photograph showing the structure of the specimen of Example 1.

Referring to FIG. 2, a mixed structure of pearlite and ferrite was observed in the core of the specimen of Comparative Example 1, and referring to FIG. 3, a mixed structure of bainite, needle-like ferrite and pearlite was observed in the core of the specimen of Example 1. That is, in the case of the cores of the steel reinforcing bars, it was observed that the specimen of Example 1 contained bainite as a low-temperature phase. Through this, it is considered that low-temperature toughness and strength can be ensured.

In addition, it was observed that the specimen of Example 1 had a smaller grain size than the specimen of Comparative Example 1. As such, it is considered that the specimen of Example 1 has a more refined microstructure than the specimen of Comparative Example 1, and thus is advantageous in preventing crack propagation.

Experiment 2

1. Preparation of Specimens

Slabs were prepared, each consisting of the component system shown in Table 4 below and the remainder being iron (Fe) and unavoidable impurities. The slabs were subjected to reheating, hot rolling and recuperation processes under the conditions shown in Table 5 below, thereby producing steel reinforcing bar specimens of Comparative Examples 6 to 9 and Examples 4 and 5, which have final diameters of 13 mm (D13) and 25 mm (D25).

TABLE 4

| | Chemical components (wt %) | | | | | | | | | | |
|---|---|---|---|---|---|---|---|---|---|---|---|
| | C | Si | Mn | P | S | Al | Mo | Ni | Cu | Cr | N |
| Component system | 0.07 | 0.12 | 1.83 | 0.0090 | 0.0090 | 0.015 | 0.12 | 0.59 | 0.28 | 0.15 | 0.01 |

TABLE 5

| | | Operating conditions | | | | | |
|---|---|---|---|---|---|---|---|
| | Standard (diameter) | Reheating temperature (° C.) | Finishing delivery temperature (° C.) | Amount of cooling water ($m^3$/hr) | Water pressure (bar) | Line speed (meters/sec) | Recuperation temperature (° C.) |
| Comparative Example 6 | D13 | 1050 | 950 | 1005 | 5.4 | 6.8 | 500 |
| Example 4 | D13 | 1050 | 950 | 1005 | 5.4 | 10.5 | 570 |
| Comparative Example 7 | D13 | 1050 | 950 | 1005 | 5.4 | 12.5 | 640 |
| Comparative Example 8 | D25 | 1200 | 1000 | 1200 | 6.0 | 5.0 | 500 |

TABLE 5-continued

| | Standard (diameter) | Operating conditions | | | | | |
|---|---|---|---|---|---|---|---|
| | | Reheating temperature (° C.) | Finishing delivery temperature (° C.) | Amount of cooling water ($m^3$/hr) | Water pressure (bar) | Line speed (meters/sec) | Recuperation temperature (° C.) |
| Example 5 | D25 | 1200 | 1000 | 1200 | 6.0 | 7.5 | 595 |
| Comparative Example 9 | D25 | 1200 | 1000 | 1200 | 6.0 | 11.4 | 640 |

Referring to Tables 4 and 5 above, Comparative Examples 6 and 7 and Example 4 are steel reinforcing bar (D13) specimens having a diameter of 13 mm. In Comparative Example 6, the recuperation temperature was 500° C., which is lower than the lower limit of the recuperation temperature range used in the production of the steel reinforcing bars according to the Examples of the present application. In Comparative Example 7, the recuperation temperature was 640° C., which is higher than the upper limit of the recuperation temperature range used in the production of the steel reinforcing bars according to the Examples of the present application. The remaining operating conditions were the same between Comparative Examples 6 and 7 and Example 4. That is, the remaining processes for Comparative Examples 6 and 7 and Example 4 were performed in the same manner at a billet reheating temperature of 1,050° C. and a finishing delivery temperature of 950° C., and the cooling process in these Examples was performed in the same manner using a cooling water amount of 1005 $m^3$/hr and a water pressure of 5.4 bar.

Comparative Examples 8 and 9 and Example 5 are steel reinforcing bar (D25) specimens having a diameter of 25 mm. In Comparative Example 8, the recuperation temperature was 500° C., which is lower than the lower limit of the recuperation temperature range used in the production of the steel reinforcing bars according to the Examples of the present application. In Comparative Example 9, the recuperation temperature was 640° C., which is higher than the upper limit of the recuperation temperature range used in the production of the steel reinforcing bars according to the Examples of the present application. The remaining operating conditions were the same between Comparative Examples 8 and 9 and Example 5. That is, the remaining processes of Comparative Examples 8 and 9 and Example 5 were performed in the same manner at a billet reheating temperature of 1,200° C. and a finishing delivery temperature of 1,000° C., and the cooling process in these Examples was performed in the same manner using a cooling water amount of 1,200 $m^3$/hr and a water pressure of 6.0 bar.

2. Evaluation of Physical Properties

Table 6 below shows the results of evaluating the hardened layer depths and mechanical properties of the specimens of Comparative Examples 6 to 9 and Examples 4 and 5, prepared under the conditions shown in Tables 4 and 5 above.

The hardened layer depth is expressed as the ratio of the depth, at which tempered martensite is formed, from the surface of each of the steel reinforcing bar specimens of Comparative Examples 6 to 9 and Examples 4 and 5, to the radius of each steel reinforcing bar specimen. The mechanical properties to be evaluated were divided into room temperature properties and cryogenic properties at −170° C. The cryogenic properties are the results obtained by separately preparing specimens according to the European Standard EN 14620-3 and performing tensile testing on the specimens. As tensile specimens for evaluation of the cryogenic properties, unnotched specimens and notched specimen are prepared. The notched specimen according to the European Standard EN 14620-3 may have a V-notch having an internal angle of 45°, and the V-notch may have a radius of 0.25 mm at the base. The V-notch may be formed at a position corresponding to ½ of the length of the specimen between the grips of a tensile tester.

For the specimens of Comparative Examples 6 to 9 and Examples 4 and 5, evaluation of the room temperature properties was performed, and for the specimens of Examples 4 and 5, evaluation of the cryogenic properties at −170° C. was performed.

TABLE 6

| | Hardened layer depth (ratio relative to radius) | Room temperature properties | | | | Cryogenic properties (−170° C.) | | | |
|---|---|---|---|---|---|---|---|---|---|
| | | YS (MPa) | TS (MPa) | TS/YS | EL (%) | YS_un (MPa) | UE_un (%) | TS_n (MPa) | NSR |
| Comparative Example 6 | 0.57 | 631 | 712 | 1.13 | 12.4 | — | — | — | — |
| Example 4 | 0.38 | 553 | 677 | 1.22 | 13.4 | 810 | 9.0 | 911 | 1.12 |
| Comparative Example 7 | 0.24 | 490 | 588 | 1.2 | 14.2 | — | — | — | — |
| Comparative Example 8 | 0.65 | 644 | 728 | 1.13 | 14.1 | — | — | — | — |
| Example 5 | 0.47 | 570 | 676 | 1.19 | 16.9 | 836 | 10.2 | 920 | 1.10 |
| Comparative Example 9 | 0.29 | 496 | 595 | 1.20 | 17.7 | — | — | — | — |

Referring to Table 6 above, for the billets having the same alloy composition shown in Table 4 above, operations were performed at different recuperation temperatures as shown in Table 5 above. As a result, the produced steel reinforcing bar specimens showed different hardened layer depths depending on the recuperation temperature.

When examining the specimens of Comparative Examples 6 and 7 and Example 4, it can be confirmed that as the recuperation temperature increased, the depth of the hardened layer decreased. Similarly, when examining the specimens of Comparative Examples 8 and 9 and Example 5, it can be confirmed that as the recuperation temperature increased, the depth of the hardened layer decreased.

Then, when examining the room temperature properties of the specimens of Comparative Examples 6 and 7 and Example 4, the specimen of Comparative Example 6, in which the recuperation temperature is lower than the lower limit of the recuperation temperature used in the production method of the present application, did not achieve a target value of tensile strength (TS)/yield strength (YS) ratio of 1.15 or more at room temperature. The specimen of Comparative Example 7, in which the recuperation temperature is higher than the upper limit of the recuperation temperature used in the production method of the present application, did not achieve a target value of yield strength of 500 MPa or more at room temperature. On the contrary, the specimen of Example 4 satisfied all the target values of room temperature properties.

Meanwhile, when examining the results of evaluation of the cryogenic properties at −170° C., the specimen of Example 4 showed a yield strength of unnotched specimen (YS_un) of 810 MPa, a uniform elongation of unnotched specimen (UE_un) of 9.0%, a tensile strength of notched specimen (TS_n) of 911 MPa, and a notch sensitivity ratio (NSR) of 1.12. Thus, the specimen of Example 4 satisfied all the target values of cryogenic properties at −170° C.

When examining the room temperature properties of the specimens of Comparative Examples 8 and 9 and Example 5, the specimen of Comparative Example 8, in which the recuperation temperature is lower than the lower limit of the recuperation temperature used in the production method of the present application, did not achieve the target value of tensile strength (TS)/yield strength (YS) ratio of 1.15 or more at room temperature. The specimen of Comparative Example 9, in which the recuperation temperature is higher than the upper limit of the recuperation temperature used in the production method of the present application, did not achieve the target value of yield strength of 500 MPa or more at room temperature. On the contrary, the specimen of Example 5 satisfied all the target values of room temperature properties.

Meanwhile, when examining the results of evaluation of the cryogenic properties at −170° C., the specimen of Example 5 showed a yield strength of unnotched specimen (YS_un) of 836 MPa, a uniform elongation of unnotched specimen (UE_un) of 10.2%, a tensile strength of notched specimen (TS_n) of 920 MPa, and a notch sensitivity ratio (NSR) of 1.10. Thus, the specimen of Example 5 satisfied all the target values of cryogenic properties at −170° C.

Although the present disclosure has been described with the embodiments, those skilled in the art will appreciate that various modifications or changes are possible. These various modifications or changes are considered to be included in the present disclosure, as long as they do not depart from the scope of the present disclosure. Therefore, the scope of the present disclosure should be defined by the appended claims.

What is claimed is:

1. A steel reinforcing bar comprising 0.06 wt % to 0.11 wt % of carbon (C), more than 0 and not more than 0.25 wt % of silicon (Si), 0.8 wt % or more and less than 2.0 wt % of manganese (Mn), more than 0 and not more than 0.01 wt % of phosphorus (P), more than 0 and not more than 0.01 wt % of sulfur (S), 0.01 to 0.03 wt % of aluminum (Al), 0.50 to 1.00 wt % of nickel (Ni), 0.027 to 0.125 wt % of molybdenum (Mo), more than 0 and not more than 0.25 wt % of chromium (Cr), more than 0 and not more than 0.28 wt % of copper (Cu), more than 0 and not more than 0.01 wt % of nitrogen (N), and the remainder being iron (Fe) and unavoidable impurities, wherein the steel reinforcing bar has a surface layer and a core excluding the surface layer, wherein the steel reinforcing bar has, in the surface layer, a hardened layer consisting essentially of tempered martensite, and wherein the core comprises, by area fraction, 35 to 45% of bainite, 45 to 55% of ferrite, and 5 to 15% of pearlite, and wherein the hardened layer has a depth corresponding to 0.31 to 0.55 times the radius of the steel reinforcing bar from the surface of the reinforcing steel bar, wherein the steel reinforcing bar is produced by steps consisting of:

reheating a slab at a temperature of 1,030° C. to 1,250° C.;

hot-rolling the reheated slab at a finishing delivery temperature of 920° C. to 1,030° C. to form a steel reinforcing bar; and cooling the surface of the hot-rolled steel reinforcing bar to a martensite transformation starting temperature (Ms temperature) or lower through a TEMPCORE process, wherein the TEMPCORE process comprises a step of subjecting the steel reinforcing bar to recuperation at 520° C. to 600° C.

2. The steel reinforcing bar of claim 1, wherein the steel reinforcing bar satisfies a yield strength (YS) of 500 MPa or more, a tensile strength (TS)/yield strength (YS) ratio of 1.15 or more, and an elongation of 10% or more, at room temperature, and has a uniform elongation of 3% or more as measured on an unnotched specimen at 170° C., and a notch sensitivity ratio of 1.0 or more at −170° C., wherein the notch sensitivity ratio is the ratio of tensile strength of notched specimen/yield strength of unnotched specimen.

3. The steel reinforcing bar of claim 1, wherein the ferrite in the core has a grain size of 9 to 11 μm.

* * * * *